US006988500B1

(12) United States Patent
Cox

(10) Patent No.: US 6,988,500 B1
(45) Date of Patent: Jan. 24, 2006

(54) FOG FREE MEDICAL FACE MASK

(75) Inventor: Duane Cox, Atlanta, GA (US)

(73) Assignee: J. Palmero Sales Company, Inc., Stratford, CT (US)

( * ) Notice: Subject to any disclaimer, the term of this patent is extended or adjusted under 35 U.S.C. 154(b) by 0 days.

(21) Appl. No.: 10/835,622

(22) Filed: Apr. 30, 2004

Related U.S. Application Data

(60) Provisional application No. 60/470,817, filed on May 15, 2003.

(51) Int. Cl.
*A62B 7/10* (2006.01)

(52) U.S. Cl. ..... 128/206.19; 128/201.15; 128/205.27

(58) Field of Classification Search ..... 128/863, 128/201.15, 205.27, 206.19, 206.22
See application file for complete search history.

(56) References Cited

U.S. PATENT DOCUMENTS

| | | | | | |
|---|---|---|---|---|---|
| 1,795,866 | A | * | 3/1931 | King | 2/8 |
| 2,012,505 | A | * | 8/1935 | Goldsmith | 128/863 |
| 2,149,067 | A | * | 2/1939 | Otero | 128/863 |
| 2,382,364 | A | * | 8/1945 | Yant | 128/201.19 |
| 3,288,138 | A | * | 11/1966 | Sachs | 128/863 |
| 3,438,370 | A | * | 4/1969 | Krantz, Jr. | 128/863 |
| 3,500,825 | A | * | 3/1970 | Andersson et al. | 128/863 |
| 3,888,246 | A | * | 6/1975 | Lauer | 128/201.17 |
| 3,890,966 | A | * | 6/1975 | Aspelin et al. | 128/201.17 |
| 3,971,369 | A | | 7/1976 | Aspelin et al. | |
| 3,974,829 | A | * | 8/1976 | Tate, Jr. | 128/201.17 |
| 4,037,593 | A | * | 7/1977 | Tate, Jr. | 128/201.17 |
| 4,323,063 | A | * | 4/1982 | Fisichella | 128/863 |
| 4,419,993 | A | * | 12/1983 | Petersen | 128/201.15 |
| 4,583,246 | A | * | 4/1986 | Griswold | 2/2.14 |
| 4,848,366 | A | * | 7/1989 | Aita et al. | 128/863 |
| 5,307,796 | A | | 5/1994 | Kronzer et al. | |
| 5,401,342 | A | | 3/1995 | Vincent et al. | |
| 5,694,925 | A | | 12/1997 | Reese et al. | |
| 5,704,063 | A | * | 1/1998 | Tilden | 2/9 |
| 5,713,399 | A | | 2/1998 | Collette et al. | |
| D416,323 | S | | 11/1999 | Henderson et al. | |
| 6,099,670 | A | | 8/2000 | Louks et al. | |
| 6,146,580 | A | | 11/2000 | Bontaites, Jr. | |
| 6,584,976 | B2 | * | 7/2003 | Japuntich et al. | 128/206.15 |

* cited by examiner

*Primary Examiner*—Aaron J. Lewis
(74) *Attorney, Agent, or Firm*—Fattibene & Fattibene; Paul A. Fattibene; Arthur T. Fattibene

(57) ABSTRACT

A face mask having a mask body made of a shaped first material with an opening and a reduced resistance filter material placed within the opening. The reduced resistance filter material permitting air to flow relatively freely there through. In one embodiment one edge of a shield is fixed to the mask body of the face mask and covers the opening and the reduced resistance filter material protecting the opening from liquid splashes and the exhaled air flow from a user downwards, away from the user's eyes. Exhaled air from a user wearing the face mask is caused to relatively freely flow through the reduced resistance filter and to be directed downward preventing the fogging of a user's eyewear. The face mask of the present invention is particularly suited to the medical and dental profession.

4 Claims, 3 Drawing Sheets

FOG FREE MEDICAL FACE MASK

RELATED APPLICATION

This application claims the benefit of U.S. Provisional Application No. 60/470,817, filed May 15, 2003.

FIELD OF THE INVENTION

The present invention relates in general to a face mask used during medical procedures or to prevent communicable diseases or illness, and particularly to a face mask for use in preventing the fogging of eyeglasses.

BACKGROUND OF THE INVENTION

In many medical or dental procedures, it is often desirable for the medical professional to wear a mask over the mouth and nose. Typically, face masks are made of a filter material that will filter contaminants that are atomized, form an aerosol, or that are contained in the air, as well as liquid particles or liquid splashes. Masks are particularly beneficial in a dental office where high speed drilling devices, such as those used in many dental procedures in the mouth, which often causes the spread of liquid and other particles from the mouth into and throughout the air. This is additionally exacerbated by the requirement for a dental professional to work relatively closely to the patient's mouth in most dental procedures. The use of a face mask protects both the patient and the medical professional in preventing cross contamination between the patient and the medical professional or care giver.

There have been many different types of medical face masks developed in an effort to better protect individuals from contracting illness and disease. One such mask is disclosed in U.S. Pat. No. 3,971,369 entitled "Folded Cup-Like Surgical Face Mask and Method of Forming the Same" issuing to Aspelin et al on Jul. 27, 1976. Therein disclosed is a cup shaped surgical mask formed from a filtration medium that has angularly disposed foldlines. Another filtering face mask is disclosed in U.S. Pat. No. 5,307,796 entitled "Methods of Forming Fibrous Filtration Face Masks" issuing to Kronzer et al on May 3, 1994. Therein disclosed is a cup shaped non-woven fibrous shaping layer for a filtering face mask that is shaped by heating the non-woven fibrous material. Another face mask is disclosed in U.S. Pat. No. 5,694,925 entitled "Face Mask With Enhanced Seal and Method" issuing to Reese et al on Dec. 9, 1997. Therein disclosed is a face mask providing a filter body that is formed of multiple layers of filtration material with a plurality of pleats. Tie straps attached to flaps extending from the filter body form a fluid seal between the periphery of the mask and the wearer's face.

While these face masks have all been helpful in providing a face mask for use in many medical procedures, they are often uncomfortable and relatively difficult to breathe through. Additionally, the restriction on the free flow of exhaled air often causes warm, moist air to flow upward towards the user's eyes. In many applications where a user is also wearing eyewear, a face shield, glasses, or goggles, the upwardly directed moisture laden exhaled air often results in condensation or fog to be formed on the cooler eyewear, face shield, glasses, or goggle surface, obscuring the user's view. This is especially problematic in the dental profession where eyewear, face shields, glasses, or goggles are often used, as well as other visual aides used for working closely within a patient's mouth during a dental procedure.

Therefore, there is a need for an improved medical face mask that is comfortable to wear and results in easier breathing therethrough, including preventing fogging of the user's eyewear, face shield, glasses, or goggles.

SUMMARY OF THE INVENTION

The present invention is a face mask that has a mask material having an opening therein. A filter material is used to cover the opening. The filter material may have perforations facilitating transmission of air or exhaled gases and moisture, increasing breathability and preventing fogging of glasses worn by a user. The filter material has a flow resistance less than that of the mask material. In another embodiment, a shield is attached to a portion of the mask adjacent the filter material and is positioned to direct exhaled air downward. In another embodiment, a shield has an adhesive strip with a protective cover which may be removed, exposing the adhesive strip so as to adhere the shield to the mask.

It is an object of the present invention to provide a face mask that is more breathable.

It is another object of the present invention to provide a face mask that prevents fogging of a user's eyes or eyewear.

It is an advantage of the present invention that it is comfortable to wear and has a portion with a reduced resistance to the flow of air.

It is another advantage of the present invention that the flow of air is directed away form a user's eyes or eyewear.

It is a feature of the present invention that a portion of the face mask adjacent a user's mouth or nose has a reduced resistance to the flow of air relative to the remaining portion of the face mask.

It is another feature of the present invention that a shield extends over a portion of the face mask having a reduced resistance to the flow of air.

It is yet another feature of the present invention that a shield is selectively affixed to and removable from the face mask.

DETAILED DESCRIPTION OF THE PREFERRED EMBODIMENTS

Figure 1:
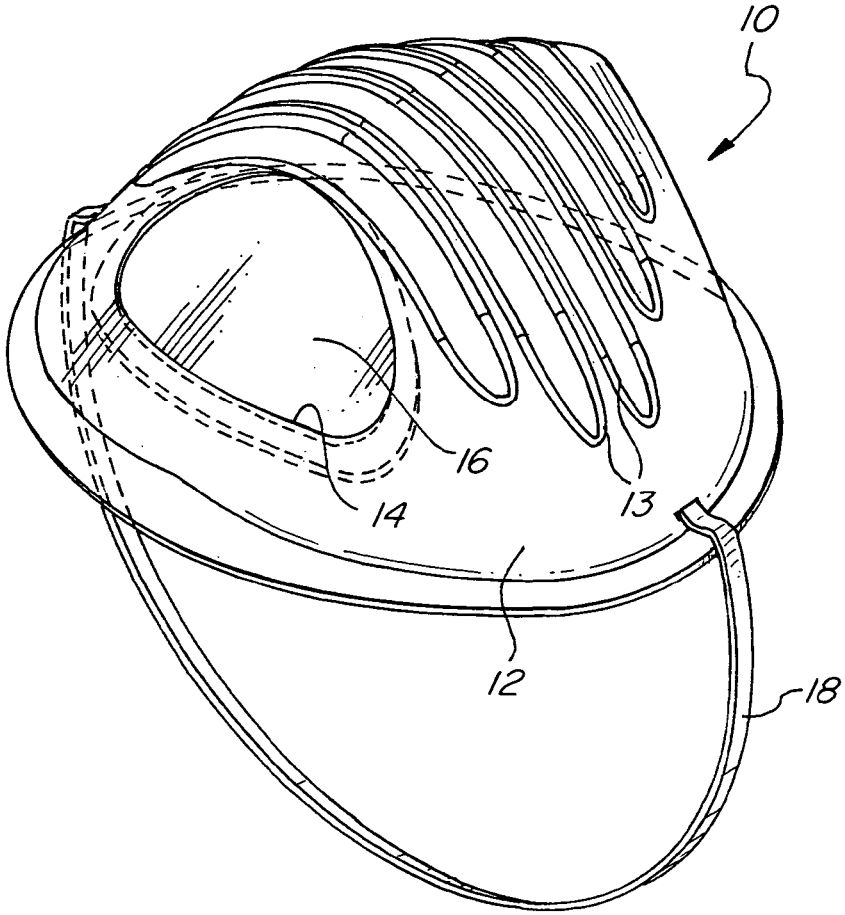
FIG. 1 is a perspective view schematically illustrating one embodiment of the invention.

FIG. 1 illustrates the fog free face mask 10. The fog free face mask 10 comprises a mask body 12 and a filter material 16. The mask body 12 may be made of any conventional mask material. Preferably, the mask material is of a woven nature that is readily disposable and inexpensive. The mask material may be made of a natural or synthetic fiber. The mask body 12 may have a plurality of ribs 13 formed therein to aid in maintaining the shape of the mask body 12. Within the mask body 12, an opening 14 is formed. The opening 14 is positioned lower on the mask body 12 so as to be near or adjacent the mouth or nose of a user.

Placed over the opening 14 is a filter material 16. The filter material 16 may be glued in position, covering the opening 14. The filter material may be perforated, but is capable of filtering liquids, particles, and aerosols of a size appropriate for the intended purpose of the fog free face mask 10. The fog free face mask 10 may be fluid proofed with a solution that prevents any fluids from penetrating the mask body 12 and the filter material 16. Any conventional fluid proofing material or solution may be used. Attached to the mask body 12 is an elastic strap 18. Other means for holding the fog free mask 10 to the face of a user may be used, such as eyeglass type earpieces or ear loops.

The fog free face mask 10 of the present invention greatly reduces fog from developing on a user's eyeglasses or eyewear. The filter material 16 permits gases and moisture to more freely pass there through relative to the mask material of the mask body 12. Accordingly, a reduced volume of exhaled air and moisture is directed upward towards the user's eyeglasses or eyewear. This reduces fog formation on the user's eyeglasses or eyewear, as well as increases breathability and comfort of the fog free mask 10. The term eyewear is intended to mean any eyeglasses, face shields, glasses, goggles, or other device intended to enhance vision, maintain vision, protect or shield the eyes.

Figure 2:
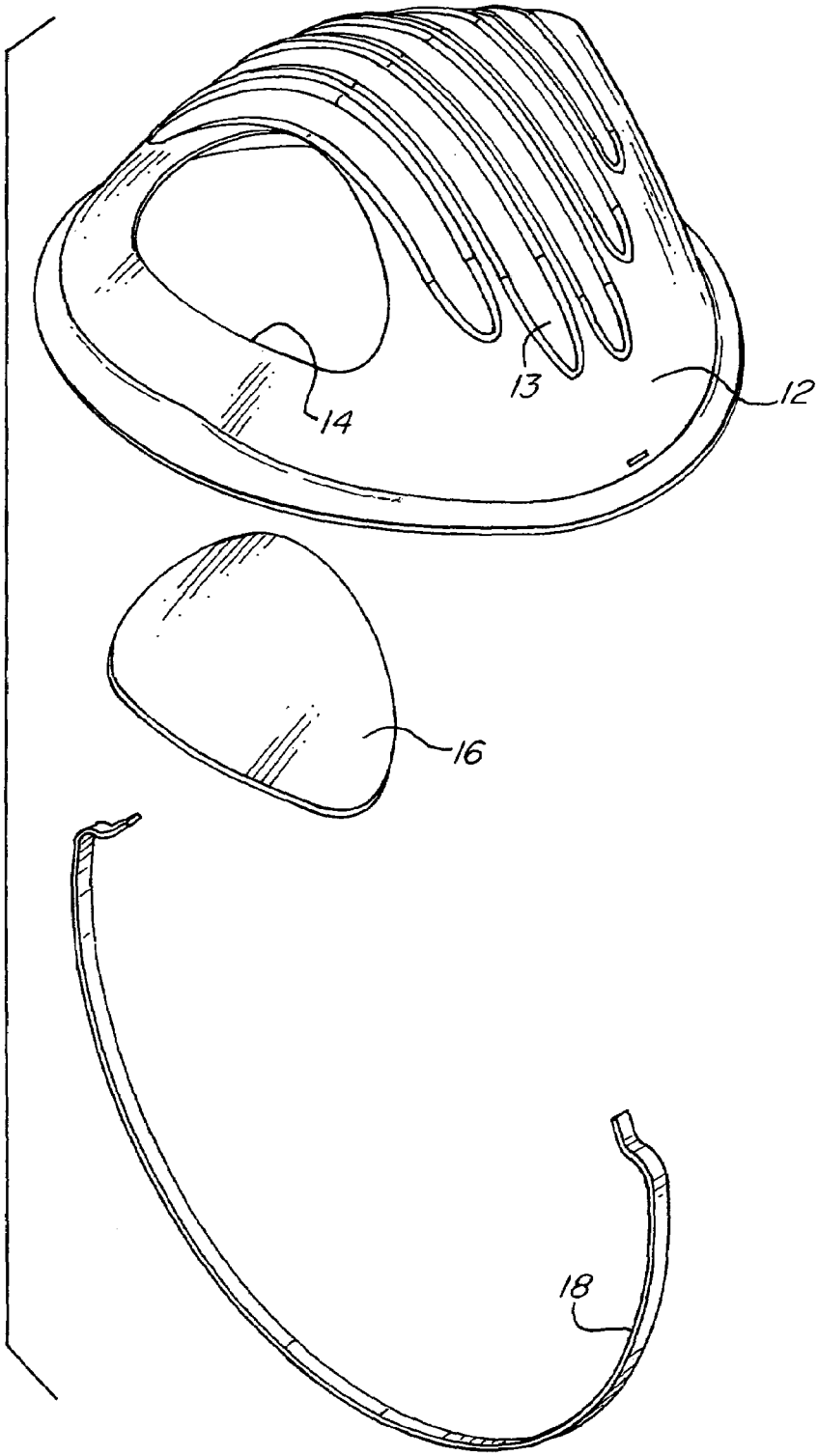
FIG. 2 is an exploded view illustrating the embodiment shown in FIG. 1.

FIG. 2 is an exploded view of the embodiment of the present invention shown in FIG. 1. In FIG. 2, the sequence of assembly is clearly illustrated with the filter material 16 being positioned within the mask body 12. The filter material 16 covers the opening 14. The filter material 16 may be glued, sewn, or otherwise adhered to the circumference or periphery of the opening 14. The filter material 16 may be ultrasonically welded to the mask body 12 material.

Figure 3:
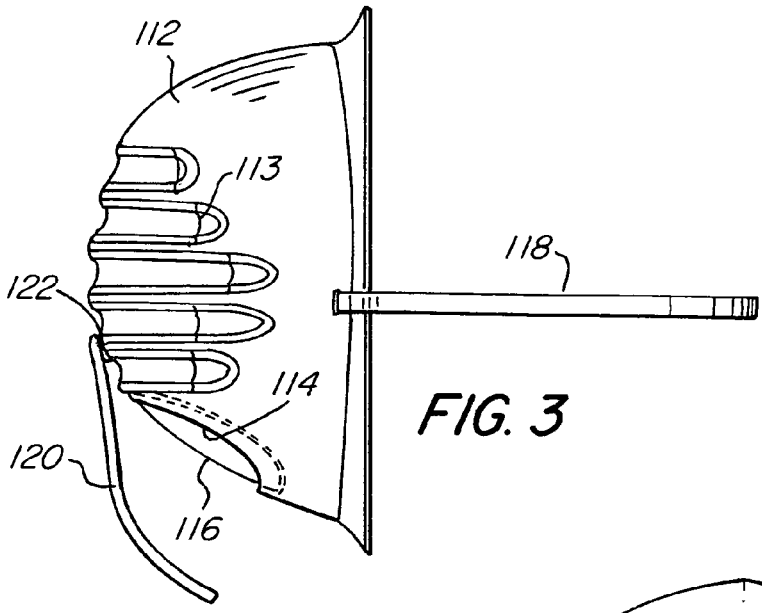
FIG. 3 is a side elevational view illustrating another embodiment of the present invention.

FIG. 3 illustrates another embodiment of the present invention incorporating a shield 120 to deflect exhaled air and gases downward, as well as to shield the filter material 116 from possible contamination. The mask body 112 may also have a plurality of ribs 113 to help maintain the shape of the mask body 112. Within an opening 114, the filter material 116 is placed. The filter material 116 has a lower resistance to the passage of air than the mask body 112. An elastic strap 118 helps to hold the mask body 112 onto a user's face. On the mask body 112 is a point of attachment 122 for the shield 120. The point of attachment 122 may be any flattened section sufficient to permit an edge of the shield 120 to adhere with an appropriate adhesive. The shield 120 may also be sonically welded to the mask body 112. The shield 120 is positioned so as to direct exhaled gases and moisture downward. The shield may also act as a splash shield preventing fluids or other particles from directly contacting the filter material 116. The shield 120 may be made of a plastic or other suitable material, such as a non-porous material. The shield 120 may also be made of the same woven material as the mask material.

Figure 4:
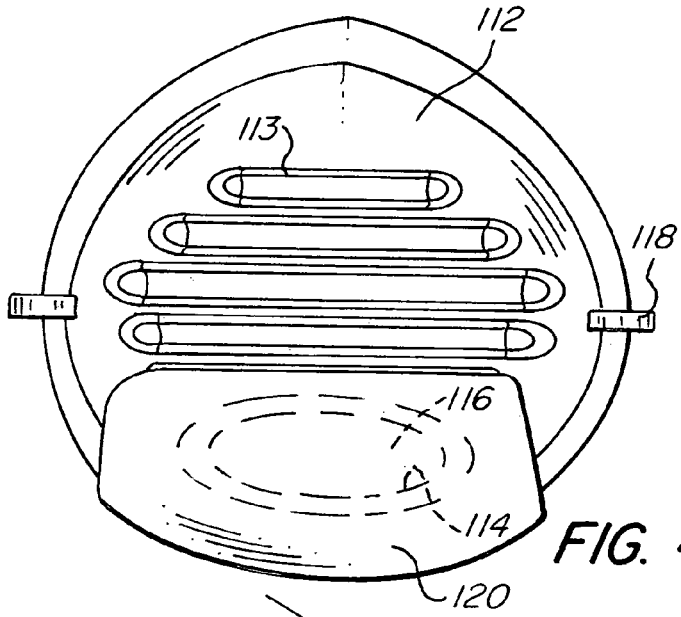
FIG. 4 is a front elevational view illustrating the embodiment shown in FIG. 3.

FIG. 4 is a plan view illustrating the positioning of the shield 120. The shield 120 is larger than the opening 114 in which the filter material 116 is placed. This assures that the entire filter material 116 is shielded.

Figure 5:
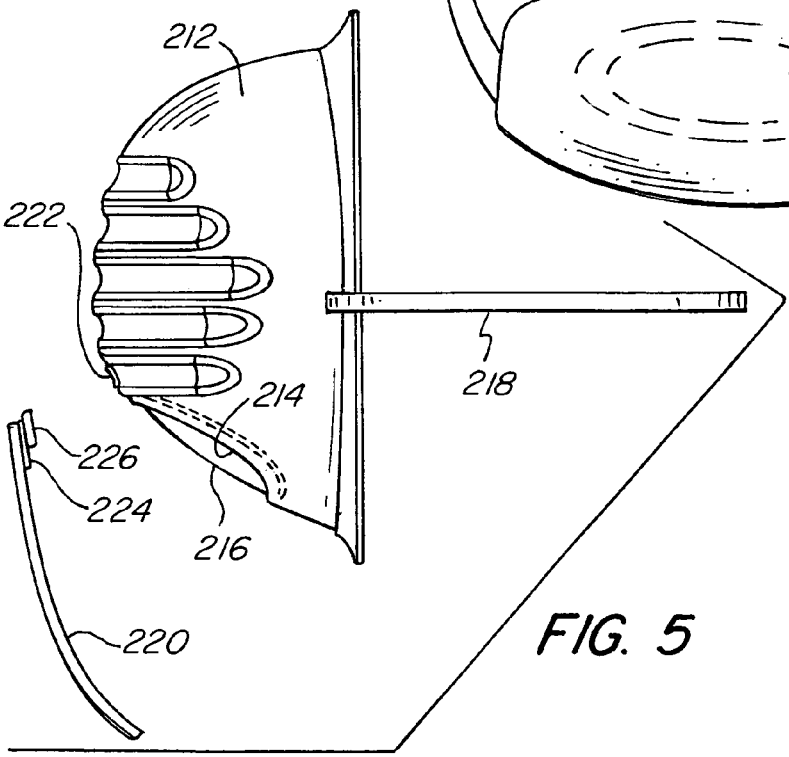
FIG. 5 is a side elevational view illustrating another embodiment of the present invention.

FIG. 5 illustrates another embodiment of the present invention having an attachable shield 220. The mask body 212 has an opening 214 with a filter material 216 placed therein. The mask body 212 also has a flat section 222. The mask 212 may be held onto a user with the aid of the elastic strap 218. In this embodiment, the attachable shield 220 has an adhesive strip 224 along one edge. Covering the adhesive strip 224 is a releasable protective cover 226. The flat section 222 on the mask body 212 is adapted or configured to mate or match with the adhesive strip 224 upon removal of the releasable protective cover 226. The shield 220 may then be readily attached to the flat section 222 on the mask body 212. Therefore, the fog free face mask illustrated in FIG. 5 may be utilized with or without the attachable shield 220. Additionally, the fog free face mask illustrated in FIG. 5 may be packaged in stacks, nested within each other, with the attachable shields 220 provided separately. This facilitates packaging and shipment.

Accordingly, the present invention has a filter material placed adjacent or near the mouth or nose of a user that permits gases and moisture that are exhaled to exit the face mask more freely than the material of the mask body. This greatly prevents the possibility of eyeglasses worn by a user to fog. Additionally, the face mask of the present invention has improved breathability and comfort.

What is claimed is:

1. An initially disassembled face mask for assembly and use by a medical professional user comprising:

a cup shaped mask body made of a first material;

a hole formed in said mask body at a location that is adjacent a user's mouth and nose when worn on the medical professional user's face;

a filter covering said hole, said filter made of a second material, wherein the second material has a flow resistance less than the first material;

an initially unattached shield having a periphery associated with said cup shaped mask body;

an adhesive strip formed along a portion of the periphery of said initially unattached shield; and a removable protective cover placed over said adhesive strip, whereby the medical professional user is capable of removing said removable protective cover exposing said adhesive strip and attaching said initially unattached shield to said cup shaped mask body over and spaced from said filter.

2. A disassembled face mask for assembly and use by a medical professional user as in claim 1 wherein:

said filter is perforated.

3. A disassembled face mask for assembly and use by a medical professional user as in claim 1 further comprising:

an elastic strap attached to said mask body.

4. A method of making a face mask comprising the steps of:

forming a cup shaped mask body;

cutting a hole in the cup shaped mask body adjacent the location of a user's mouth and nose;

placing a filter material over the hole; and attaching one edge of a shield adjacent to the hole so that the hole is covered by and spaced from the shield so as to prevent splashed fluid from contacting the filter material and to direct a user's exhaled air flowing through the filter material downward away from the user's eyes, whereby moist warm air from the user's exhaled air is prevented from being directed upward towards the user's eyes so as not to fog the user's eyewear.

* * * * *